United States Patent [19]

Butler et al.

[11] Patent Number: 4,944,164

[45] Date of Patent: Jul. 31, 1990

[54] CONVERTIBLE EARRING

[76] Inventors: Janis Y. Butler, R.D.8-372 Union Valley Rd., Mahopac, N.Y. 10541; Esther Fuhrman, P.O. Box 342, Jenkintown, Pa. 19046

[21] Appl. No.: 385,723

[22] Filed: Jul. 26, 1989

[51] Int. Cl.[5] ..... A44C 7/00

[52] U.S. Cl. ..... 63/12; 63/14.4; 63/14.5

[58] Field of Search ..... 63/12, 13, 14.1, 14.3, 63/14.4, 14.5, 14.6, 14.7, 14.8, 26, 28

[56] References Cited

U.S. PATENT DOCUMENTS

| | | | |
|---|---|---|---|
| 2,022,936 | 12/1935 | Kip, Jr. | 63/26 X |
| 2,405,525 | 8/1946 | Sherman et al. | 63/14.4 |
| 3,587,247 | 6/1971 | Crisfield | 63/145 |
| 3,613,393 | 10/1971 | Lamoureaux | 63/14.5 |
| 4,694,664 | 9/1987 | Elsener | 63/12 |

FOREIGN PATENT DOCUMENTS

| | | | |
|---|---|---|---|
| 764127 | 5/1934 | France | 63/14.4 |

*Primary Examiner*—Laurie K. Cranmer
*Attorney, Agent, or Firm*—S. C. Yuter

[57] ABSTRACT

A convertible earring comprising a rigid earring body having a surface on one side and an ear attachment on the other side, with the surface having a raised portion and an adjacent decorated portion. When the earring body is attached to one ear by the ear attachment, the raised portion hides the adjacent decorated portion behind the raised portion when viewed from the front of the ear. But when the earring body is attached to the other ear, the adjacent decorated portion is visible in front of the raised portion when viewed from the front of the other ear. Thus a pair of such earrings is convertible to a more decorated pair of earrings by simply switching each earring from one ear to the other. The raised portion may be a step, an outwardly curved surface or a wall. Or the surface of the earring body may have a decorated raised portion and an adjacent but hidden differently decorated portion so the earring is convertible to a differently decorated earring by switching the earring from one ear to the other. The decorated portion can comprise any distinguishing area such as a plurality of gemstones, enamel or leather work or a patterned, textured or colored surface, or different colored metals such as gold and silver.

28 Claims, 3 Drawing Sheets

FIG. 3T
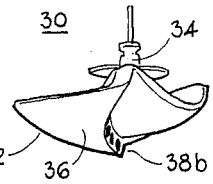
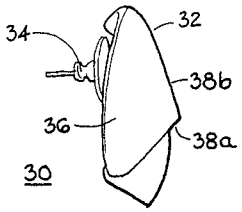
FIG. 3L
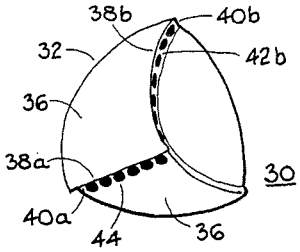
FIG. 3F
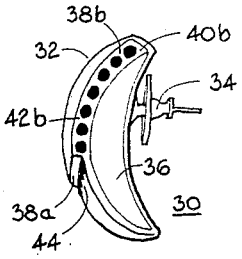
FIG. 3R
FIG. 4T
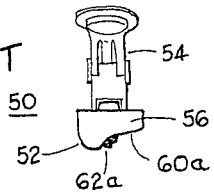
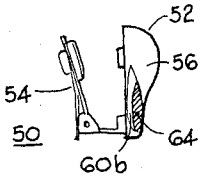
FIG. 4L
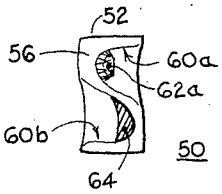
FIG. 4F
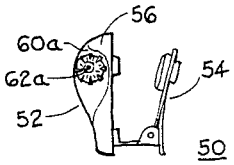
FIG. 4R
FIG. 5T
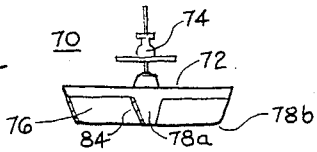
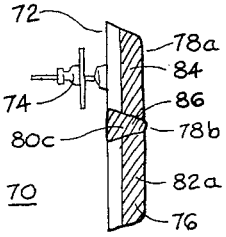
FIG. 5L
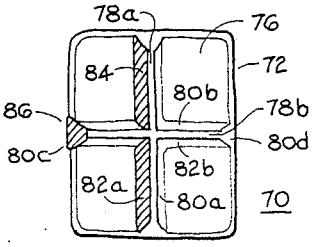
FIG. 5F
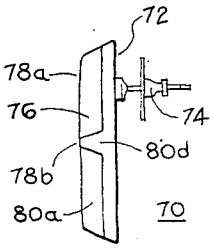
FIG. 5R FIG. 6T
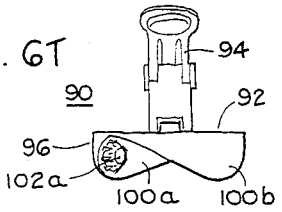
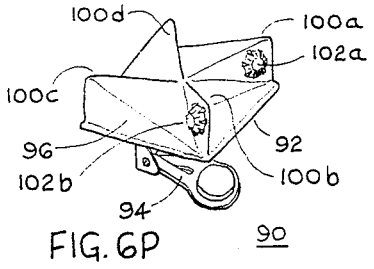
FIG. 6P
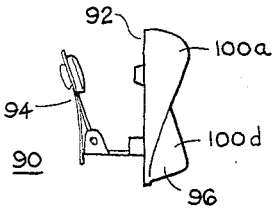
FIG. 6L
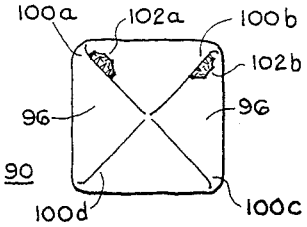
FIG. 6T
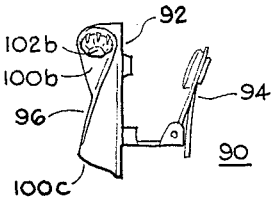
FIG. 6R
FIG. 7T
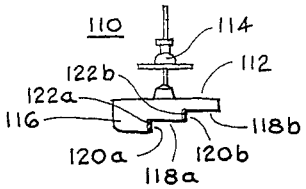
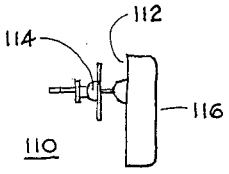
FIG. 7L
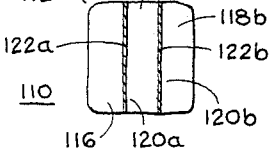
FIG. 7T
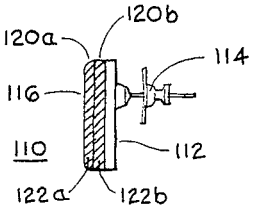
FIG. 7R
FIG. 8T
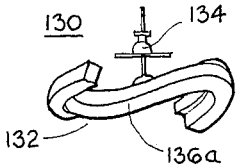
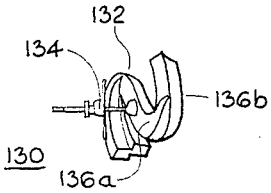
FIG. 8L
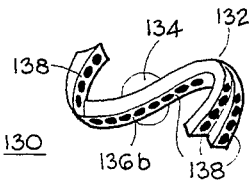
FIG. 8F
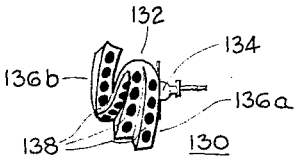
FIG. 8R

CONVERTIBLE EARRING

BACKGROUND OF THE INVENTION

1. Field of the Invention

This invention generally relates to jewelry and more particularly to earrings that can readily be converted from one type to another.

2. Description of the Related Art

2. Prior earrings have been convertible to a different appearance by structural arrangements for physically interchanging one portion with another. Roesch Pat. No. 4,655,054 issued Apr. 7, 1987 for an Interchangeable Jewelry Assembly discloses a jewelry ornament with a fastening loop which is interchangeably joined with an ear attachment such as an ear piercing post and clutch so that different ornaments may be hung from a common ear attachment. However, that requires that small jewelry ornaments be carried separately, which can be expensive due to the need for separate jewelry components and are subject to loss and awkward to convert.

SUMMARY OF THE INVENTION

It is a general object of the invention to provide a convertible earring whose conversion is simple and easy.

It is another object of the invention to provide a one-piece and thus correspondingly less expensive convertible earring.

It is a further object of the invention to provide a convertible earring which is relatively easy to manufacture.

It is a still further object of the invention to provide a convertible earring which can be made as both costume and precious jewelry.

Briefly, in accordance with the invention, these and other objects are achieved by a convertible earring comprising a rigid earring body having a surface on one side and ear attachment means on the other side, with the surface having a raised portion and an adjacent decorated portion. When the earring body is attached to one ear by the ear attachment means, the raised portion hides the adjacent decorated portion behind the raised portion when viewed from the front of the ear. But when the earring body is attached to the other ear, the adjacent decorated portion is visible in front of the raised portion when viewed from the front of the other ear. Thus a pair of such earrings is convertible to a more decorated pair of earrings by simply switching each earring from one ear to the other.

In accordance with one embodiment of the invention, the raised portion is a step with the adjacent decorative portion comprising the rising portion of the step. Also, the raised portion of the surface may comprise a series of steps each followed by a decorated portion.

In accordance with another embodiment of the invention, the raised portion is an outwardly curved surface and the adjacent decorated portion comprises the portion of the outwardly curved surface hidden from view.

In accordance with a further embodiment of the invention, the raised portion is a wall and the adjacent decorated portion comprises one side of the wall. The wall may have sloping sides with the adjacent decorated portion comprising one sloping side of the wall.

In accordance with still another embodiment of the invention the surface of the earring body has a decorated raised portion and an adjacent but hidden differently decorated portion so the earring is convertible to a differently decorated earring by switching the earring from one ear to the other.

In accordance with a further embodiment of the invention the earring body has an ear attachment means angularly connected to one side and the surface of the one side is undecorated and the other side decorated. When the earring body is attached to one ear by the angularly connected ear attachment means the undecorated side angularly extends outwardly from the back to the front and hides the decorated side when the earring body is viewed from the front of the ear. When the earring body is attached to the other ear by the angularly connected ear attachment means, the decorated side angularly extends outwardly from the front to the back and is visible when viewed from the front of the other ear.

In accordance with a still further embodiment of the invention the decorated portion on the surface of the earring body immediately follows the raised portion; for example, immediately follows the rising portion of a step rather than being on the rising portion, but remains hidden by the step when the earring body is viewed from the front of the ear.

A feature of the invention is the decorated portions, which can comprise any distinguishing area such as a plurality of gemstones, enamel or leather work or a patterned, textured or colored surface, or different colored metals such as gold and silver.

A principal advantage of the invention is that the earring looks different depending on how it is positioned by the wearer who effectively has two pieces of jewelry in one. This is advantageous for several reasons.

First, many working women are called upon to travel directly from their day's workplace to an evening entertainment. While women often prefer a conservative look for the jewelry they wear to the office, they may want a less conservative look for the evening. For example, they may want a plain gold earring for daytime wear, but an earring with sparkling gemstones for evening wear. The invention allows the wearer to have both "looks" in the same pair of earrings, so that it is not necessary for the wearer to carry an extra pair of earrings to which to change for evening wear.

Another advantage to the hidden area "two-in-one" reversible earrings is that they allow the buyer to have jewelry that potentially matches different articles of clothing. For example, gemstones of a certain color may be revealed when the earrings are positioned so that those color stones are facing forward. When the wearer positions the earrings so the other sides show, either no gemstones or gemstones of another color are revealed. As with the daytime-to-evening example, this versatility means the wearer does not need to change jewelry in order to be wearing what is appropriate for each outfit.

Other objects, features and advantages of the invention will be apparent from the following description of the preferred embodiments when read in connection with the figures of the accompanying three sheets of drawings.

BRIEF DESCRIPTION OF THE DRAWINGS

FIG. 2 shows various views of the convertible earring shown in FIG. 1.

FIG. 3 second sheet shows various views of the convertible earring in accordance with another embodiment of the invention in which the raised surfaces are steps, with the decorated portion on the rising portion of a step or immediately following it. FIG. 3L is a side elevational view of the left earring as would be worn by the woman at the left of FIG. 1. FIG. 3R is a side elevational view of the left earring as would be worn by the woman at the right of FIG. 1 after being switched from the left ear to the right ear. FIG. 3T is a top view and FIG. 3F is a front elevational view.

FIG. 4 shows various views of the convertible earring in accordance with another embodiment of the invention in which the raised surfaces are outwardly curved surfaces, with decorated portions on both sides of the outwardly curved surfaces. FIG. 4L is a side elevational view of the left earring as would be worn by the woman at the left of FIG. 1. FIG. 4R is a side elevational view of the left earring as would be worn by the woman at the right of FIG. 1 after being switched from the left ear to the right ear. FIG. 4T is a top view and FIG. 4F is a front elevational view.

FIG. 5 shows various views of the convertible earring in accordance with another embodiment of the invention in which the raised surfaces are sloping walls, with decorated portions on one of the sloping walls. FIG. 5L is a side elevational view of the left earring as would be worn by the woman at the left of FIG. 1. FIG. 5R is a side elevational view of the left earring as would be worn by the woman at the right of FIG. 1 after being switched from the left ear to the right ear. FIG. 5T is a top view and FIG. 5F is a front elevational view.

FIG. 6 (third sheet) shows various views of the convertible earring in accordance with another embodiment of the invention in which the raised surfaces are outwardly curved surfaces, with decorated portions on the outwardly curved surfaces. FIG. 6L is a side elevational view of the left earring as would be worn by the woman at the left of FIG. 1. FIG. 6R is a side elevational view of the left earring as would be worn by the woman at the right of FIG. 1 after being switched from the left ear to the right ear. FIG. 6T is a top view, FIG. 6F is a front elevational view and FIG. 6P a side perspective view.

FIG. 7 shows various views of the convertible earring in accordance with another embodiment of the invention in which the raised surfaces are a series of steps, with decorated portions on the rising portions of each step. FIG. 7L is a side elevational view of the left earring as would be worn by the woman at the left of FIG. 1. FIG. 7R is a side elevational view of the left earring as would be worn by the woman at the right of FIG. 1 after being switched from the left ear to the right ear. FIG. 7T is a top view and FIG. 7F is a front elevational view.

FIG. 8 shows various views of the convertible earring in accordance with another embodiment of the invention in which the rigid earring body is angularly connected to the ear attachment means with the decorated portion on the side of the earring body which is hidden from view. FIG. 8L is a side elevational view of the left earring as would be worn by the woman at the left of FIG. 1. FIG. 8R is a side elevational view of the left earring as would be worn by the woman at the right of FIG. 1 after being switched from the left ear to the right ear. FIG. 8T is a top view and FIG. 8F is a front elevational view.

DESCRIPTION OF THE PREFERRED EMBODIMENTS

Figure 1:
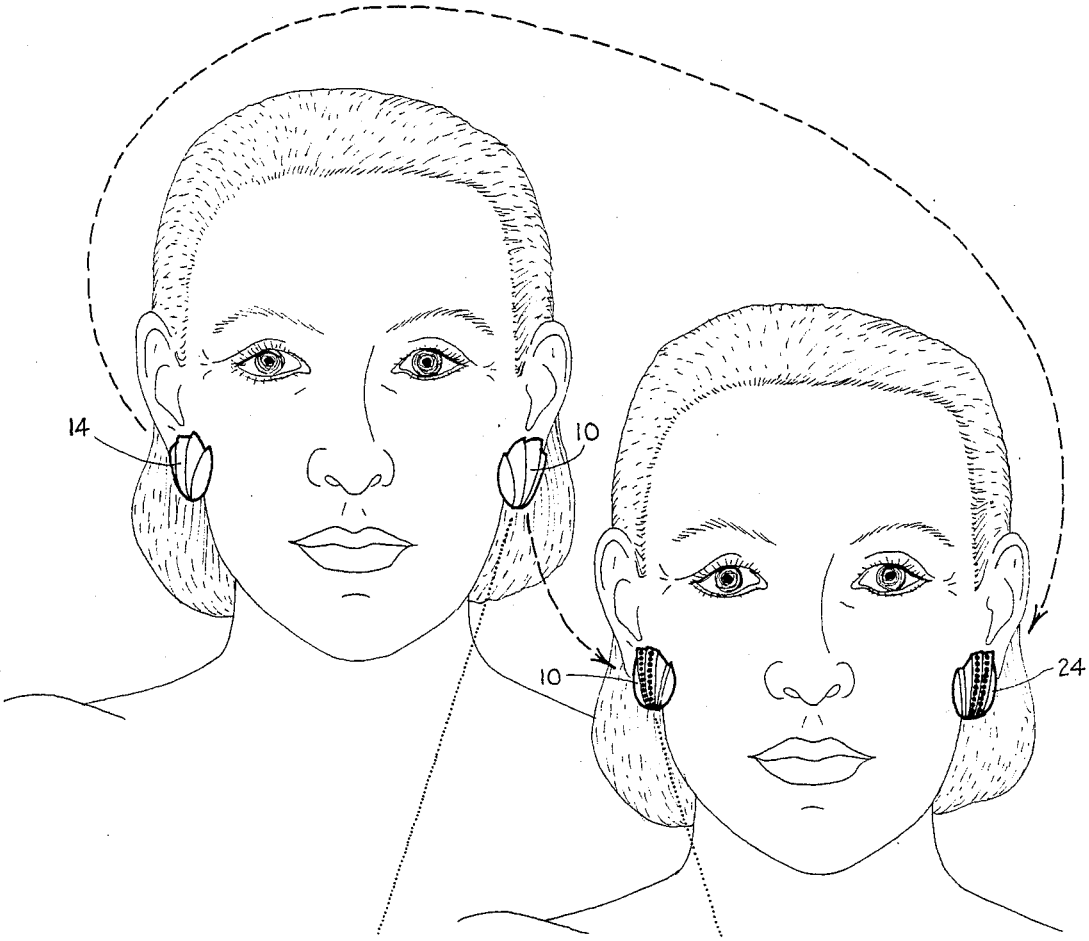
FIG. 1 first sheet is a front elevational view of a woman, on the left wearing the convertible earrings in accordance with the best mode of the invention in which the raised surface portion are steps, with the raised surfaces hiding the decorative portions, and on the right with rows of decorative gemstones showing on the rising portions of the steps after the earrings are switched from one ear to the other.
Figure 2T:
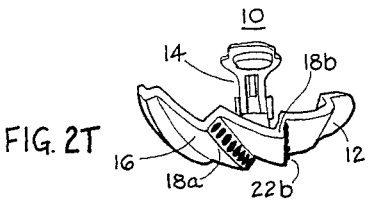
FIG. 2T is a top view and FIG. 2F is a front elevational view.
Figure 2L:
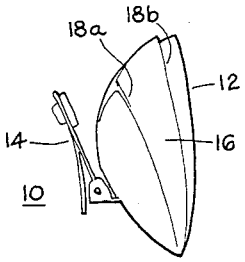
FIG. 2L is a side elevational view of the left earring as worn by the woman at the left of FIG. 1.
Figure 2F:
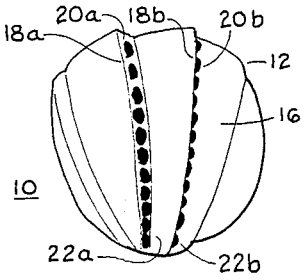
Figure 2R:
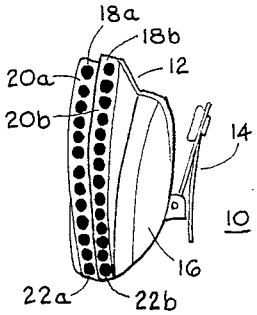
FIG. 2R is a side elevational view of the left earring as worn by the woman at the right of FIG. 1 after being switched from the left ear to the right ear.

Referring to FIGS. 1 and 2, a convertible earring 10 is shown having a rigid earring body 12 (FIG. 2) and ear attachment means 14 consisting of a standard spring loaded ear clip. The rigid earring body 12 has an outer surface 16 having two steps 18*a* and 18*b* with associated rising portions 20*a* and 20*b*. In each rising portion 20*a* and 20*b* is an associated set of gemstones 22*a* and 22*b*, which are glued in matingly shaped holes in the outer surface 16.

When the rigid earring body 12 of convertible earring 10 is attached to the left ear (at the left center of FIG. 1) by the ear attachment means 14, the raised portion of each step 18*a* and 18*b* hides the adjacent decorated portions consisting of the gemstones 22*a* and 22*b* behind the raised portions when viewed from the front of the ear. But when the convertible earring 10 is attached to the right ear (at the right center of FIG. 1), the gemstones 22*a* and 22*b* are visible in front of the raised portion when viewed from the front of the right ear.

Convertible earring 24 is attached to the right ear (at the left of FIG. 1) by ear attachment means (not shown). Convertible earring 24 is the mirror image of convertible earring 10 and is constructed exactly the same way.

Thus a pair of such earrings is convertible to a more decorated pair of earrings by simply switching each earring from one ear to the other.

The convertible earrings 12 and 24 may be costume jewelry or more expensive precious jewelry.

In more expensive jewelry the gemstones are held in place by prongs or a bezel. Usually precious stones are set and fake stones are glued, gluing being faster and cheaper. A bezel is a grooved ring or rim which surrounds the edge of a stone and holds it in place. Often in will be bent along the groove to grip the stone. Sometimes a bezel takes the shape of a dish with a flat bottom, like a cake tin, and the stone is glued to the bottom. Prongs are little fingers that hold stones in place. The tops of the prongs bend over at the edge to hold the stone in place.

Costume jewelry is typically made by centrifugal casting. "White metal" (pewter, a mixture of lead and tin) is heated to a liquid state and poured into a mold which is spun on a centrifuge to fill all the crannies of the mold. When cooled, the jewelry is released from the mold, polished (usually by hand) and dipped in several liquid baths—copper to seal the white metal and prevent if from eating through the final finish causing a tarnished look; nickel for brilliance, and a gold or silver wash which is electroplated on for the final color.

Precious metal jewelry (gold and silver) is typically made by the lost wax process, the same process used in making bronze statuary. These are called castings. Another way to make costume and precious metal jewelry is to stamp it out of sheets of metal. These are called stamping.

In the case of precious metal jewelry the ear attachment means, a clip or post (for pierced ears), is soldered on. In the case of costume jewelry with a post, the post can be soldered on but more typically the post is put into the mold and is cast into the molten white metal. This makes a stronger piece since the post is less likely to come off. Clips for nonpierced ears are always soldered onto costume jewelry. They cannot be cast because it is important that they be lightweight and therefore they are usually made of brass or nickel and filigreed to remove as much metal as possible to achieve the optimum combination of lightness and strength. Clips are pre-formed, stamped out of a sheet of metal and soldered onto the earring.

The stones in precious metal jewelry are usually set in; i.e. tightly positioned in bezels or prongs because usually people want real gold or silver jewelry to contain genuine stones and therefore want the security provided by bezels and prongs.

The stones in costume jewelry are usually glued in because, typically, the types of stones set into costume jewelry are less expensive or even fake, and it is not important to protect them from loosening and loss. Of course, it is much cheaper in terms of labor to glue than to set, since all of this work is done by hand.

The gemstones 22 in the convertible earrings 12 and 24 are just one form of decoration. In accordance with the invention, other types of decoration in addition to gemstones may be used including any distinguishing area such as enamel or leather work or a patterned, textured or colored surface, or different colored metals such as gold and silver.

"Gemstones, stones, gems" is a general term used to describe naturally occurring decorations that can enhance the appearance of jewelry. Diamonds, amethysts, jade, turquoise, onyx, garnet, etc. can be called gems, stones or gemstones. Pearls and shell (mother of pearl) also qualify.

Fake or faux gems, stones and gemstones are not made of natural material. For example, plastic, polyester resin and other types of resin can be used to create fake stones. Cubic zirconium, though man-made, is organically grown and therefore purports to be "real."

Enamel (cloissone), paint, leather and other hides and skins can be used in the hidden areas of the convertible earrings 12 and 24.

Metals that contrast with the basic metal used in the piece, for example, a gold earring having a hidden area of silver, could also be used.

The following shapes of decoration also can be used in accordance with the invention: Stones of virtually any shape (square, round, oblong, marquis, pear, etc.): Stones cut or faceted in any way to produce a surface that has many aspects, and smooth finishes as in a cabochon.

Also finishes that create unique textures may be used. For example, a shiny surface earring may have a hidden area that is rough-textured. The rough texture can be created by patterns on the surface of the metal, by buffing, or by any other means that would create contrast.

The convertible earrings disclosed in FIGS. 3–8 in accordance with other embodiments of the invention are similar in construction and types of decoration of the hidden areas as earrings 10 and 24 shown in FIGS. 1 and 2, whose description is incorporated by reference for those additional embodiments for purpose of brevity.

Referring to FIG. 3 (sheet two), a convertible earring 30 is shown having a rigid earring body 32 and ear attachment means 34 consisting of a standard post and clutch for pierced ears. The rigid earring body 32 has an outer surface 36 having two steps **38*a* and 38*b* with associated rising portions 40*a* and 40*b*. In rising portion 40*b* is a set of gemstones 42*b*. Immediately following rising portion 40*a* in the outer surface 36 is a set of gemstones 44. Gemstones 42*b* and 44 are glued in matingly shaped holes in the outer surface 36**.

When the rigid earring body 32 of convertible earring 30 is attached to the left ear (at the left center of FIG. 1) by the ear attachment means 34, the raised portion of each step **38*a* and 38*b* hides the adjacent decorated portions consisting of the gemstones 44 and 42*b* behind the raised portions when viewed from the front of the ear. But when the convertible earring 30 is attached to the right ear (at the right center of FIG. 1), the gemstones 44 and 42*b*** are visible in front of the raised portions when viewed from the front of the right ear.

Thus a mirror image pair of such earrings is convertible to a more decorated pair of earrings by simply switching each earring from one ear to the other.

Referring to FIG. 4, a convertible earring 50 is shown having a rigid earring body 52 and ear attachment means 54 consisting of a standard spring loaded ear clip. The rigid earring body 52 has an outer surface 56 having two mirror image upwardly curved rising portions **60*a* and 60*b* (like a love seat). In rising portion 60*a* is a gemstone 62*a*. In rising portion 60*b* in the outer surface 66 is an engraved decorated area 64. Gemstone 62*a* is set in prongs connected to outer surface 56**.

When the rigid earring body 52 of convertible earring 50 is attached to the left ear (at the left center of FIG. 1) by the ear attachment means 54, the rising portion **60*a* hides the adjacent decorated portion consisting of the gemstone 62*a* behind the raised portion when viewed from the front of the ear. But the engraved decorated area 64 is visible. When the convertible earring 50 is attached to the right ear (at the right center of FIG. 1), the gemstone 62*a* is visible in front of the raised portion when viewed from the front of the right ear but the engraved decorated area 64** is not visible.

Thus a mirror image pair of such earrings is convertible from a decorated pair of earrings to a more decorated pair by simply switching each earring from one ear to the other.

Referring to FIG. 5 a convertible earring 70 is shown having a rectangular rigid earring body 72 and ear attachment means 74 consisting of a standard post and clutch for pierced ears. The rectangular rigid earring body 72 has an outer surface 76 having two orthogonal sloped walls **78*a* and 78*b* with associated rising wall portions 80*a*–82*a* and 80*b*–82*b*. In rising wall portion 82*a* is an engraved decorated area 84. Neither side of sloping wall 78*b* has any decoration but its end has a sloping end wall 80*c* on which is an engraved decorated area 86**.

When the rigid earring body 72 of convertible earring 70 is attached to the right ear (at the right center of FIG. 1) by the ear attachment means 74, the rising wall portion **80*a* of sloping wall 78*a* hides the adjacent decorated portions consisting of the engraved decorated areas 84 and 86 behind the raised portions when viewed from the front of the ear. But when the convertible earring 70 is attached to the left ear (at the left center of FIG. 1), the engraved decorated areas 84 and 86 are visible in front of the rising wall portion 80***a* of sloping wall 78*a* when viewed from the front of the left ear.

Thus a mirror image pair of such earrings is convertible to a more decorated pair of earrings by simply switching each earring from one are to the other.

The outer corners of the rectangular rigid earring body 72 of the convertible earring 70 may be truncated to form a diamond shaped convertible earring.

Referring to FIG. 6 (sheet 3), a convertible earring 90 is shown having a rigid earring body 92 and ear attachment means 94 consisting of a standard spring loaded ear clip. The rigid earring body 92 has an outer surface 96 having four upwardly curved rising portions 100*a*–100*d*. In rising portion 100*a* is a gemstone 102*a* and in rising portion 100*b* is a gemstone 102*b*. Gemstones 102*a* and 102*b* are each set in prongs connected to outer surface 96.

When the rigid earring body 92 of convertible earring 90 is attached to the left ear (at the left center of FIG. 1) by the ear attachment means 94, the rising portion 100*a* hides the adjacent decorated portion consisting of the gemstone 102*a* as well as the gemstone 102*b* when viewed from the front of the ear. When the convertible earring 90 is attached to the right ear (at the right center of FIG. 1), the gemstone 102*b* is visible in front of the rising portion 100*b* when viewed from the front of the right ear but the gemstone 102*a* is not visible except by a substantially taller person.

Thus a mirror image pair of such earrings is convertible from an undecorated pair of earrings to a decorated pair by simply switching each earring from one ear to the other.

Referring to FIG. 7, a convertible earring 110 is shown having a rigid earring body 112 and ear attachment means 114 consisting of a standard post and clutch for pierced ears. The rigid earring body 112 has an outer surface 116 having two parallel steps 118*a* and 118*b* with associated rising portions 120*a* and 120*b*. On each of the rising portions 120*a* and 120*b* is an engraved decorated area.

When the rigid earring body 112 of convertible earring 110 is attached to the left ear (at the left center of FIG. 1) by the ear attachment means 114, the raised portion of each step 118*a* and 118*b* hides the adjacent decorated portions when viewed from the front of the ear. But when the convertible earring 110 is attached to the right ear (at the right center of FIG. 1), the engraved decorated areas are visible in front of the raised portions when viewed from the front of the right ear.

Thus a mirror image pair of such earrings is convertible to a more decorated pair of earrings by simply switching each earring from one ear to the other.

Referring to FIG. 8, a convertible earring 130 is shown having a rigid earring body 132 and an angularly connected ear attachment means 134 consisting of a standard post and clutch for pierced ears. The rigid earring body 132 has an undecorated inner surface 136*a* and an outer surface 136*b*. In outer surface 136*b* is a set of gemstones 138 which are glued in matingly shaped holes in outer surface 136*b*.

When the earring body 132 is attached to the left ear (at the left center of FIG. 1) by the angularly connected ear attachment means 134 the undecorated inner surface 136*a* angularly extends outwardly from the back to the front and hides the decorated outer surface 136*b* when the earring body is viewed from the front of the ear. When the earring body 132 is attached to the right ear (at the left center of FIG. 1) by the angularly connected ear attachment means 134, the outer surface 136*b* angularly extends outwardly from the front to the back and gemstones 138 are visible when viewed from the front of the right ear.

Thus a mirror image pair of such earrings is convertible to a more decorated pair of earrings by simply switching each earring from one ear to the other.

What is claimed is:

1. A convertible earring comprising:

(A) a rigid earring body having a surface on one side and ear attachment means on the other side;

(B) said surface having a raised portion and an adjacent decorated portion; whereby (C) when said earring body is attached to one ear by said ear attachment means, said raised portion hides said adjacent decorated portion behind said raised portion when said earring body is viewed from the front of the ear; and (D) when said earring body is attached to the other ear by said ear attachment means, said adjacent decorated portion is visible in front of said raised portion when viewed from the front of the other ear;

(E) said earring body thereby being convertible to a more decorated earring body when viewed from the front of an ear by switching the attachment of said earring body from one ear to the other.

2. A convertible earring according to claim 1 wherein said raised portion of said surface of said rigid earring body is a step followed by said adjacent decorated portion.

3. A convertible earring according to claim 2 wherein said adjacent decorated portion comprises the raised portion of said step.

4. A convertible earring according to claim 2 wherein said adjacent decorated portion follows the raised portion of said step.

5. A convertible earring according to claim 1 wherein said raised portion of said surface of said rigid earring body is an outwardly curved surface.

6. A convertible earring according to claim 5 wherein said adjacent decorated portion comprises said outwardly curved surface.

7. A convertible earring according to claim 5 wherein said adjacent decorated portion follows said outwardly curved surface.

8. A convertible earring according to claim 1 wherein said raised portion of said surface of said rigid earring body is a wall followed by said adjacent decorated portion.

9. A convertible earring according to claim 8 wherein said adjacent decorated portion comprises one side of said wall.

10. A convertible earring according to claim 8 wherein said wall has sloping sides and said adjacent decorated portion comprises one sloping side of said wall.

11. A convertible earring according to claim 8 wherein said adjacent decorated portion follows said wall.

12. A convertible earring according to claim 1 wherein said raised portion of said surface of said rigid earring body comprises a plurality of steps each followed by a decorated portion.

13. A convertible earring according to claim 12 wherein each of said adjacent decorated portions comprises the rising portion of the associated step.

14. A convertible earring according to claim 1 wherein said adjacent decorated portion comprises a plurality of gemstones.

15. A convertible earring according to claim 1 wherein said adjacent decorated portion comprises enamel work.

16. A convertible earring according to claim 1 wherein said adjacent decorated portion comprises a pattern in said surface.

17. A convertible earring according to claim 1 wherein said adjacent decorated portion comprises a textured surface.

18. A convertible earring according to claim 1 wherein said adjacent decorated portion comprises a colored surface.

19. A convertible earring according to claim 1 wherein said adjacent decorated portion comprises a distinguishing area.

20. A convertible earring comprising:

(A) a rigid earring body having a surface on one side and ear attachment means on the other side;

(B) said surface having a decorated raised portion and an adjacent differently decorated portion; whereby (C) when said earring body is attached to one ear by said ear attachment means, said decorated raised portion hides said differently decorated portion behind said decorated raised portion when said earring body is viewed from the front of the ear; and (D) when said earring body is attached to the other ear by said ear attachment means, said differently decorated portion is visible in front of said decorated raised portion when viewed from the front of the other ear;

(E) said earring body thereby being convertible to a differently decorated earring body when viewed from the front of an ear by switching the attachment of said earring body from one ear to the other.

21. A convertible earring comprising:

(A) a rigid earring body having an ear attachment means angularly connected to one side;

(B) the surface of said one side being undecorated;

(C) the other side of said rigid earring body being decorated; whereby (D) when said earring body is attached to one ear by said angularly connected ear attachment means, said undecorated side angularly extends outwardly from the back to the front and hides said decorated side when said earring body is viewed from the front of the ear; and (E) when said earring body is attached to the other ear by said angularly connected ear attachment means, said decorated side angularly extends outwardly from the front to the back and is visible when viewed from the front of the other ear;

(F) said earring body thereby being convertible to a more decorated earring body when viewed from the front of an ear by switching the attachment of said earring body from one ear to the other.

22. A convertible earring comprising:

(A) a rigid earring body having an ear attachment means on one side;

(B) said rigid earring body also comprising a decorated portion; whereby (C) when said earring body is attached to one ear by said ear attachment means, said decorated portion is hidden from view when said earring body is viewed from the front of the ear; and (D) when said earring body is attached to the other ear by said ear attachment means, said decorated portion is visible when viewed from the front of the other ear;

(E) said earring body thereby being convertible to a more decorated earring body when viewed from the front of an ear by switching the attachment of said earring body from one ear to the other.

23. A convertible earring according to claim 22 wherein said decorated portion comprises a plurality of gemstones.

24. A convertible earring according to claim 22 wherein said decorated portion comprises enamel work.

25. A convertible earring according to claim 22 wherein said decorated portion comprises a pattern in said surface.

26. A convertible earring according to claim 22 wherein said decorated portion comprises a textured surface.

27. A convertible earring according to claim 22 wherein said decorated portion comprises a colored surface.

28. A convertible earring according to claim 22 wherein said decorated portion comprises a distinguishing area.

* * * * *